US006790001B2

(12) United States Patent
Turnquist et al.

(10) Patent No.: US 6,790,001 B2
(45) Date of Patent: Sep. 14, 2004

(54) BRUSH SEAL ARRANGEMENT FOR HIGH PRESSURE APPLICATIONS

(75) Inventors: Norman Arnold Turnquist, Sloansville, NY (US); Mark Edward Burnett, Buskirk, NY (US); Christopher Edward Wolfe, Niskayuna, NY (US); Frederick George Baily, Ballston Spa, NY (US); Daniel Richard Cornell, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/301,586

(22) Filed: Nov. 22, 2002

(65) Prior Publication Data

US 2004/0101403 A1 May 27, 2004

(51) Int. Cl.[7] ..... F01D 11/00
(52) U.S. Cl. ..... 415/174.2; 415/231
(58) Field of Search ..... 415/170.1, 173.3, 415/173.5, 174.2, 174.5, 230, 231; 277/355

(56) References Cited

U.S. PATENT DOCUMENTS 4,756,536 A * 7/1988 Belcher ..... 277/355
5,474,306 A 12/1995 Bagepalli et al.
6,105,967 A 8/2000 Turnquist et al.
6,250,640 B1 6/2001 Wolfe et al.
6,250,641 B1 6/2001 Dinc et al.
6,250,879 B1 * 6/2001 Lampes ..... 415/174.2
6,257,586 B1 7/2001 Skinner et al.
6,261,057 B1 7/2001 Turnquist et al.
6,308,957 B1 * 10/2001 Wright ..... 277/355
6,367,806 B1 * 4/2002 Turnquist et al. ..... 277/355

* cited by examiner

*Primary Examiner*—Ninh H. Nguyen
(74) *Attorney, Agent, or Firm*—Nixon & Vanderhye

(57) ABSTRACT

In a steam turbine high pressure end seal region, brush seals are provided between first and second pressure regions having a pressure drop in excess of the sealing capacity of an individual brush seal. To use brush seals between the first and second regions, one or more intermediate pressure regions are maintained at a substantially fixed predetermined pressure between the first and second pressure regions. Brush seals are interposed between adjacent pressure regions whereby the pressure drop between adjacent pressure regions is within the sealing capacity of the individual brush seal disposed between the adjacent pressure regions.

4 Claims, 2 Drawing Sheets

BRUSH SEAL ARRANGEMENT FOR HIGH PRESSURE APPLICATIONS

BACKGROUND OF THE INVENTION

The present invention relates to brush seal arrangements for sealing between pressure regions having a pressure drop in excess of the capacity of individual brush seals and particularly relates to a brush seal arrangement for steam turbine high pressure end seals wherein the pressure drop across any one brush seal is within the sealing capacity of the one brush seal.

In turbomachinery, brush seals have been previously proposed and constructed for use between relatively moving parts having a pressure differential across the parts. In steam turbines typically comprising a stationary housing and a rotor mounting a plurality of buckets wherein steam under pressure passes through a steam path to rotate the buckets and rotor, there are a number of locations requiring seals between relatively moving parts. For example, low pressure end seals in a steam turbine frequently employ a combination of brush and labyrinth seals mounted on a plurality of arcuate segments for sealing between the high and low pressure regions on opposite axial sides of the sealing segments. Brush seals, of course, typically include a plurality of bristles, for example, metal or ceramic bristles usually disposed between a pair of backing plates and arranged in an arcuate segment such that the tips of the bristles engage the surface, e.g., a rotary surface, to be sealed. While advantageous, brush seals per se, however, have inherent limitations. These limitations may be exemplified by reference to the high pressure end seals in a steam turbine. Inlet pressures for large steam turbines are typically in a range of 1800–3500 psig. At the high pressure end seal location, steam leakage flow is driven by the pressure drop from the control stage outlet pressure to the next fixed pressure, typically the high pressure section exhaust pressure of approximately one-quarter inlet pressure. The pressure drop may exceed 2000 psig. Steam flow through this leakage path is reduced by a series of labyrinth seal rings disposed between the two pressure regions. Existing single-stage brush seals, however, are capable of sealing across pressure drops of up to 400 psig, which can reasonably be extended to approximately 600 psig by reducing the length of the unsupported bristles at the seal inner diameter, i.e., the fence height. Fence height reduction, however, has its own limitation because adequate clearance must be given for expected seal/rotor transients.

Use of brush seals in series to share the total overall pressure load, i.e., the total differential pressure drop between the high pressure control stage outlet and the HP section exhaust pressure is impractical because there is a natural tendency for the pressure distribution to be biased toward the downstream seals. Thus, the downstream seals, if formed of brush seals, would take a disproportionate or larger percentage of the total pressure load and may exceed the brush seal capacity. Consequently, only labyrinth-type seals are typically used at the high pressure end seal location in a steam turbine, i.e., at those locations where the pressure drop is in excess of the capacity or capability of a conventional brush seal. Accordingly, there is a need for an arrangement of brush seals for sealing across pressure drops in excess of the capability of individual brush seals.

BRIEF DESCRIPTION OF THE INVENTION

In accordance with a preferred embodiment of the present invention, there is provided a brush seal arrangement for sealing between high pressure regions having a total pressure drop in excess of any individual brush seal sealing capability. To accomplish the foregoing, and with reference to an exemplary embodiment of the sealing arrangement in a steam turbine high pressure end seal, the overall pressure drop which is in excess of the sealing capacity of any individual brush seal is divided into several discrete pressure drops of lesser magnitude. Each pressure drop lies within the design capacity of the brush seal. To accomplish this, the division of the overall pressure drop into several discrete lesser pressure drops includes establishing pressure regions on opposite sides of individual brush seals. These pressure regions are at relatively substantially fixed predetermined pressures and are in communication with other locations of the turbine system that are at such intermediate pressures. For example, at the high pressure end seal of a steam turbine, an intermediate pressure region may comprise an intermediate pressure connection at an interstage location or a connection to an extraction to a heater above the reheat point (HARP). In this manner, the pressure drop across any one brush seal between adjacent pressure regions may be set within the design capacity of the brush seal. The result is that the entire high pressure end seal region or a portion of that region can be effectively sealed using brush seals which typically offer more significant leakage reduction as compared to conventional labyrinth seals usually used to seal these locations in steam turbines.

In a preferred embodiment according to the present invention, there is provided a turbine comprising a stationary component and a rotary component, first and second seal assemblies axially spaced from one another between the stationary component and the rotary component, each of the first and second seal assemblies including a brush seal for sealing across a pressure differential, each the brush seal having a predetermined maximum differential sealing pressure defining a sealing capacity therefor, the turbine including a first high pressure region upstream of the first seal and a second lower pressure region downstream of the second seal, the first and second pressure regions having a total pressure drop in excess of the sealing capability of each brush seal of the first and second brush seal assemblies, at least one pressure region intermediate the first and second pressure regions and between the first and second seal assemblies, the one intermediate pressure region having a substantially fixed predetermined pressure such that the predetermined sealing capacity of each brush seal between one of (i) the first and intermediate pressure regions and (ii) the intermediate and the second pressure regions is not exceeded.

In a further preferred embodiment according to the present invention, there is provided a steam turbine comprising a stationary component, a rotary component within the stationary component and having a plurality of buckets, a steam inlet for supplying steam to the buckets to rotate the rotary component, the turbine having a high pressure end adjacent the steam inlet, first and second seals axially spaced from one another between the stationary component and the rotary component at the high pressure end, each of the first and second seals including a brush seal, the turbine including a first steam pressure region exposed to high pressure steam on a side thereof upstream of the first seal, a second steam pressure region downstream of the second seal, the first and second pressure regions having a total pressure drop in excess of the sealing capability of each of the first and second brush seals, at least one pressure region intermediate the first and second pressure regions and between the first and second seals having a substantially fixed predetermined pressure such that a pressure differential across one of the first and second seals is within the sealing capability of the one seal.

DETAILED DESCRIPTION OF THE INVENTION

Figure 1:
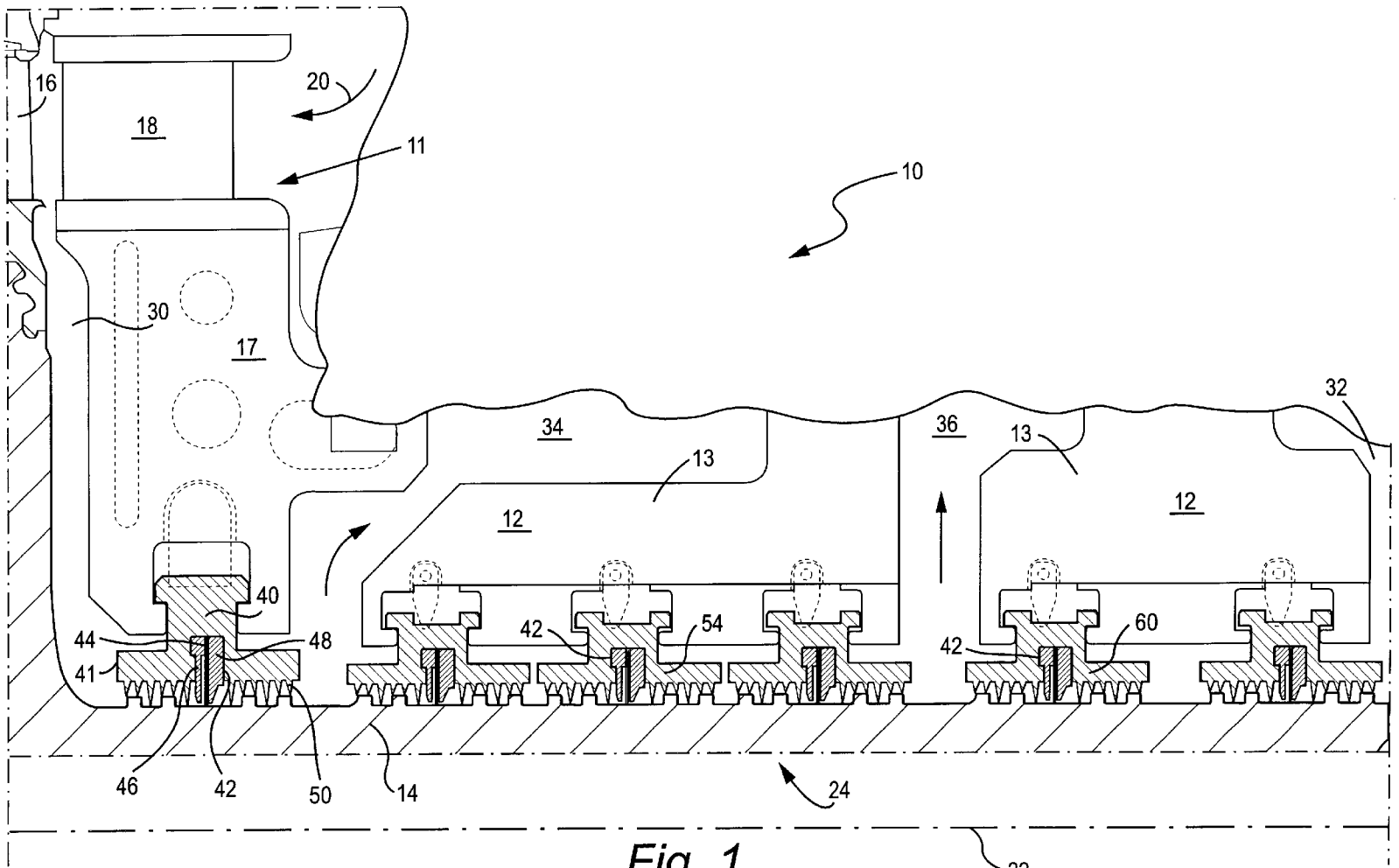
FIG. 1 is an enlarged fragmentary cross-sectional view illustrating an upper half of a high pressure end seal for a steam turbine.

Referring now to the drawings, particularly to FIG. 1, there is illustrated a portion of a turbine, generally designated 10, for example, a steam turbine. A conventional turbine 10 includes a rotor 14 mounting a plurality of buckets 16 at axially spaced positions therealong (only one bucket being illustrated) and nozzles, generally indicated 11, including stator blades 18 (only one stator blade being illustrated) axially interspersed between the buckets 16 to form a plurality of turbine stages. A steam inlet, not shown, provides steam from a suitable source, not shown, for flow along the steam path indicated by the arrow 20, through the turbine stages for rotating the rotor 14 relative to stationary components 12 of the turbine. The stationary components 12 may, e.g., include packing ring casings 13 secured to an inner shell, now shown, nozzles 11 and an inner web 17 of the first stage. The rotor axis is indicated at 22. As illustrated in FIG. 1, the rotor 14 extends upstream of the first stage of the turbine and requires sealing about the stationary components 12. These stationary components 12 include packing ring segments described below and which comprise a high pressure end seal region, generally designated 24.

Typically, the high pressure end seal region 24 is sealed by a plurality of axially spaced, arcuate sealing rings or segments carried by the stationary components 12, e.g., the inner web, 17 and packing ring casings 13, of the turbine. Each of the segments cooperates with circumferentially adjacent segments to form an annular seal about the rotor at each of the axial locations along the high pressure end seal region 24. Each segment also includes a plurality of labyrinth seal teeth spaced from and in close proximity to the surface of the rotor to provide a series of axially spaced labyrinth seals. However, substantial leakage flows occur when employing conventional labyrinth seals in the high pressure end seal region which degrade the efficiency of the turbine. As noted previously, brush seals have been demonstrated to provide a more effective seal against secondary flow leakages but cannot typically be utilized when pressure drops exceed the sealing capacity of the brush seal. In the illustrated example of the high pressure end sealing region of a steam turbine, the pressure drop between the upstream and downstream pressures may be in a range of 1800 to 3500 psia. The typical brush seal may have a maximum sealing capacity for sealing across a pressure drop of about 400 psia and possibly 600 psia with reasonable refinement and extrapolation of current brush seal designs.

In order to effectively utilize brush seals for sealing across regions having a higher pressure drop than brush seal capacity, there is provided in accordance with a preferred embodiment of the present invention one or more intermediate pressure regions at substantially fixed predetermined pressures between upstream (first) and downstream (second) pressure regions which define the total pressure drop across the area to be sealed. The intermediate pressure region(s) are located relative to one another and to the first and second pressure regions such that the pressure drop across each brush seal assembly between adjacent pressure regions is within the capacity of the one or more brush seals forming the brush seal assembly. Each brush seal assembly may comprise one brush seal or two or more brush seals arranged in series. As a consequence, the total pressure drop across any one brush seal assembly located between adjacent pressure regions lies within the design capability of the one or more brush seals of the brush seal assembly. The total pressure drop between pressure regions having a pressure differential exceeding the capacity of an individual brush seal can therefore be effectively sealed using brush seal assemblies, either alone or in combination with labyrinth-type seals, in conjunction with one or more intermediate fixed pressure regions.

In a particular preferred embodiment of the present invention illustrated in FIG. 1, there is illustrated a high pressure end seal region 24 incorporating one or more intermediate pressure regions between the first and second pressure regions defining the overall total pressure drop. For example, in FIG. 1, a first pressure region 30 is defined as a steam leakage path from the steam path toward a lower pressure region, i.e., a second pressure region 32. The first pressure region is essentially at a steam inlet pressure and the second pressure region 32 is at a steam exhaust pressure. Thus, a pressure drop exists between the first and second pressure regions 30 and 32 which is beyond the sealing capacity of any individual brush seal. In accordance with a preferred embodiment of the present invention, however, intermediate pressure regions at substantially fixed pressures are located between the first (high) and second (low) pressure regions so that the pressure drop between any adjacent intermediate pressure regions and between the first pressure region and an adjacent intermediate pressure region, as well as an adjacent intermediate pressure region and the second pressure region is within the sealing capacity of a brush seal assembly disposed therebetween. Thus, a first intermediate pressure region 34 is established at a substantially fixed pressure between the first and second pressure regions 30 and 32, respectively. One or more additional intermediate pressure regions, for example, a second intermediate pressure region 36, may also be interposed between the first intermediate pressure region 34 and the second intermediate pressure region 32. A brush seal assembly is located between adjacent pressure regions. The brush seal assembly may comprise a single brush seal between the adjacent pressure regions or may comprise two or more brush seals in series provided that, in each case, the pressure across the individual brush seal(s) lies within the brush seal capacity. Alternatively, the brush seal between adjacent pressure regions may be utilized in combination with other types of seals, for example, labyrinth seals. Thus, the pressure drop between adjacent pressure regions may exceed the capacity of individual brush seals of the brush seal assembly provided the pressure drop across each brush seal of the assembly thereof does not exceed the capacity of the individual brush seal(s) of the assembly. By locating one or more pressure regions at fixed pressures between the high and low pressure regions defining the total pressure drop, adjacent pressure regions may have a pressure drop within the sealing capacity of a brush seal interposed therebetween or may have a pressure drop in excess of the capacity of any one brush seal provided the pressure drop across each brush seal interposed between is within its capacity. Hence, brush seal assemblies may be utilized for sealing across pressure drops where the total pressure drop exceeds the sealing capacity of any individual brush seal.

Figure 2:
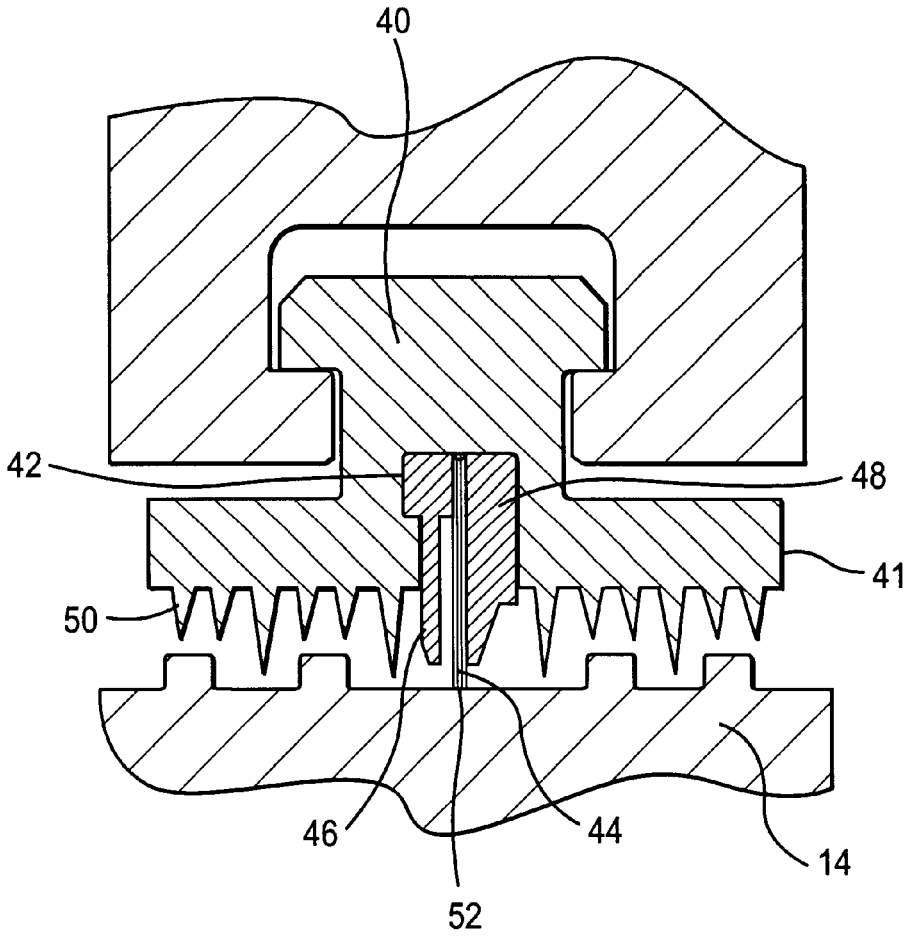
FIG. 2 is an enlarged cross-sectional view of an arcuate sealing segment between the stationary component and rotor employing a combined labyrinth and brush seal arrangement.

In a preferred embodiment, a plurality of circumferentially adjacent seal rings 40 are provided. Each seal ring 40 includes a plurality of seal ring segments 41 mounting a brush seal 42 which, when the segments are adjoined circumferentially, form an annular brush seal arrangement. As best illustrated in FIG. 2, the brush seals 42 may comprise conventional brush seals with a plurality of bristles 44, for example, formed of metal or a ceramic material, disposed between forward and backing plates 46 and 48, respectively, in a groove of the sealing segment. It will be appreciated that the tips 52 of the bristles 44 engage the surface of the rotor 14. The brush seals 42 are illustrated in combination with a plurality of labyrinth seal teeth 50 provided on the sealing ring segments. However, the brush seals may be used without the labyrinth teeth if necessary or desirable.

As illustrated in FIG. 1, the plurality of seal ring segments 41 each carry a brush seal 42 and are disposed between the first pressure region 30 and the first intermediate pressure region 34. The pressure drop between regions 30 and 34 lies within the capability of the brush seals 42. Also illustrated in FIG. 2 is a plurality of similar axially spaced sealing ring segments 54, each carrying a brush seal 42. The brush seals 42 formed on segments 54 lie between intermediate pressure regions 34 and 36 wherein the pressure drop between regions 34 and 36 lies within the sealing capacity of an individual brush seal. A plurality of brush seals 42 on the segments 54 are illustrated to provide a more effective seal than a single brush seal. Likewise, sealing ring segments 60 lying axially between an intermediate pressure region 36 and the second pressure region 32 each carry a brush seal 42. The pressure drop between pressure regions 36 and 32 is less than the sealing capacity of any individual brush seal.

It will be appreciated from the foregoing description that the pressure drop between adjacent pressure regions in the high pressure end seal region of the steam turbine lies at or below the sealing capacity of any individual brush seal interposed therebetween. By providing a substantially fixed predetermined pressure in each of the intermediate pressure regions and considering the total pressure drop, the pressure drop between adjacent pressure regions is maintained at less than the capacity of the brush seal interposed between the adjacent pressure regions. Brush seal usage in the high pressure end steam turbine seal is therefore enabled. It will also be appreciated that the pressure regions, for example, regions 34 and 36, are provided by connecting those regions with other locations in the turbine system that are at the substantially fixed intermediate pressures. For example, the location for the intermediate pressure regions may comprise turbine interstage locations or an extraction location to a heater above the reheat point.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

a stationary component and a rotary component;

first, second and third seal assemblies axially spaced from one another between the stationary component and the rotary component, each of said first, second and third seal assemblies including a brush seal for sealing across a pressure differential, each said brush seal having a predetermined maximum differential sealing pressure defining a sealing capacity therefor;

said turbine including a first high pressure region upstream of said first seal assembly and a second lower pressure region downstream of said second seal assembly;

a first pressure region intermediate said first and second seal assemblies and a second pressure region intermediate said second seal assembly and said third seal assembly;

said first high pressure region and said second intermediate pressure region having a total pressure drop therebetween in excess of the sealing capacity of each brush seal of the first and second seal assemblies;

said first intermediate pressure region and said second low pressure region having a total pressure drop therebetween in excess of the sealing capacity of each brush seal of the second and third seal assemblies;

said first intermediate pressure region having a substantially fixed predetermined pressure such that the predetermined sealing capacity of each brush seal between one of (i) said first high pressure region and said first intermediate pressure regions and (ii) said first intermediate pressure region and said second intermediate pressure region is not exceeded; and said second intermediate pressure region has a substantially fixed predetermined pressure such that the predetermined sealing capacity of each brush seal between one of (i) said first intermediate pressure region and said second intermediate pressure region and (ii) said second intermediate pressure region and said second low pressure region is not exceeded.

2. A turbine according to claim 1 wherein said first high pressure region and said first intermediate pressure region have a pressure differential within the sealing capacity of said brush seal therebetween.

3. A turbine according to claim 1 wherein said first intermediate pressure region and said second intermediate pressure region have a pressure differential within the sealing capacity of said brush seal therebetween.

4. A turbine according to claim 1 wherein at least one of said first, second and third seals assemblies includes labyrinth seal teeth.

* * * * *